US009309798B2

(12) United States Patent
Smith et al.

(10) Patent No.: US 9,309,798 B2
(45) Date of Patent: Apr. 12, 2016

(54) MULTI-PIECE MUFFLER HOUSING

(71) Applicant: Harley-Davidson Motor Company Group, LLC, Milwaukee, WI (US)

(72) Inventors: Stacy L. Smith, Oconomowoc, WI (US); Michael Protasiewicz, Waukesha, WI (US)

(73) Assignee: Harley-Davidson Motor Company Group, LLC, Milwaukee, WI (US)

( * ) Notice: Subject to any disclaimer, the term of this patent is extended or adjusted under 35 U.S.C. 154(b) by 0 days.

(21) Appl. No.: 14/220,885

(22) Filed: Mar. 20, 2014

(65) Prior Publication Data

US 2015/0267586 A1 Sep. 24, 2015

(51) Int. Cl.

| | |
|---|---|
| ***F01N 1/00*** | (2006.01) |
| ***F01N 3/28*** | (2006.01) |
| ***F01N 13/18*** | (2010.01) |
| ***F01N 13/10*** | (2010.01) |
| ***F01N 1/08*** | (2006.01) |

(52) U.S. Cl.

CPC ..... *F01N 3/2882* (2013.01); *F01N 1/089* (2013.01); *F01N 3/2885* (2013.01); *F01N 13/107* (2013.01); *F01N 13/1822* (2013.01); *F01N 13/1844* (2013.01); *F01N 13/1894* (2013.01); *F01N 2590/04* (2013.01); *Y10T 29/49718* (2015.01)

(58) Field of Classification Search

USPC ..... 60/272, 274, 299, 312, 313, 314, 322, 60/323, 324; 181/89.2, 296, 309

See application file for complete search history.

(56) References Cited

U.S. PATENT DOCUMENTS

| | | | |
|---|---|---|---|
| 3,178,208 | A | 4/1965 | Koehler |
| 3,443,911 | A | 5/1969 | Keith et al. |
| 3,675,398 | A | 7/1972 | Giarrizzo |
| 4,328,188 | A | 5/1982 | Kawata |
| 4,426,844 | A | 1/1984 | Nakano |
| 4,730,852 | A | 3/1988 | Arscott |
| 5,228,726 | A | 7/1993 | Brown et al. |
| 5,372,530 | A | 12/1994 | Holtermann et al. |

(Continued)

FOREIGN PATENT DOCUMENTS

| | | |
|---|---|---|
| EP | 0974011 B1 | 3/2002 |
| EP | 1213453 A1 | 6/2002 |

(Continued)

OTHER PUBLICATIONS

Harley-Davidson, OHC 1100, 1975, 2 pages.

*Primary Examiner* — Binh Q Tran

(74) *Attorney, Agent, or Firm* — Michael Best & Friedrich LLP

(57) ABSTRACT

The present invention provides an exhaust system for use on a motorcycle having an internal combustion engine with at least one exhaust port, the exhaust system including a first tubular member having a first end removeably coupled to the exhaust port of the internal combustion engine, and a second end, opposite the first end, forming a first connector. Where the first tubular member also includes a catalytic element positioned within the first tubular member between the first end and the second end, and where the first tubular member is gas-tight such that all exhaust gas entering the first end must pass through the catalytic element before exiting the second end. The exhaust system also includes a second member removeably coupled to the first connector of the first member, the second member having one or more baffles positioned therein.

19 Claims, 11 Drawing Sheets

(56) References Cited

U.S. PATENT DOCUMENTS

| | | | | |
|---|---|---|---|---|
| 5,408,827 | A | 4/1995 | Holtermann et al. | |
| 5,588,680 | A * | 12/1996 | Cassel et al. | 285/3 |
| 5,775,100 | A | 7/1998 | Sloss et al. | |
| 6,109,026 | A | 8/2000 | Karlsson et al. | |
| 6,131,252 | A | 10/2000 | Hoheisel et al. | |
| 6,334,501 | B1 * | 1/2002 | Kawamoto | 180/309 |
| RE37,848 | E | 9/2002 | Nanami et al. | |
| 6,688,929 | B2 | 2/2004 | Lecours et al. | |
| 7,178,498 | B2 * | 2/2007 | Takeuchi | F01M 1/12 123/196 R |
| 7,347,045 | B2 * | 3/2008 | Bozmoski | F01N 13/0097 60/287 |
| 7,413,716 | B2 | 8/2008 | Mavinahally et al. | |
| 7,490,465 | B2 | 2/2009 | Weimert et al. | |
| 7,490,871 | B2 | 2/2009 | Avram et al. | |
| 7,568,548 | B2 * | 8/2009 | Fujii et al. | 180/309 |
| 7,731,241 | B2 | 6/2010 | Aoki et al. | |
| 7,770,690 | B2 * | 8/2010 | Schorn | F01N 3/2885 180/296 |
| 7,819,222 | B2 | 10/2010 | Baum et al. | |
| 7,882,700 | B2 * | 2/2011 | Yamakura et al. | 60/323 |
| 7,895,832 | B2 * | 3/2011 | Gruber | 60/299 |
| 7,941,995 | B2 | 5/2011 | Goss et al. | |
| 8,091,349 | B2 * | 1/2012 | Sakurai | F01N 1/006 60/289 |
| 2004/0075276 | A1 | 4/2004 | Lemke et al. | |
| 2007/0220872 | A1 | 9/2007 | Weimert et al. | |
| 2009/0000287 | A1 | 1/2009 | Blaisdell et al. | |
| 2009/0072535 | A1 | 3/2009 | Baumann et al. | |
| 2011/0023471 | A1 | 2/2011 | Werni et al. | |
| 2011/0272941 | A1 | 11/2011 | Broderick et al. | |

FOREIGN PATENT DOCUMENTS

| | | | |
|---|---|---|---|
| EP | 2261475 | A1 | 12/2010 |
| EP | 2385228 | A2 | 11/2011 |
| EP | 2546489 | A1 | 1/2013 |
| EP | 2568140 | A1 | 3/2013 |
| JP | 2008267259 | A | 11/2008 |

* cited by examiner

MULTI-PIECE MUFFLER HOUSING

FIELD OF THE INVENTION

The present invention relates to an exhaust assembly for use on a motorcycle; and more specifically an exhaust assembly with a multi-piece muffler housing.

BACKGROUND OF THE INVENTION

During use, a motorcycle exhaust assembly is configured to collect exhaust gas from an engine and direct it through a catalytic element and/or a series of baffles. Specifically, the exhaust assembly is tasked with treating the exhaust gas by passing it through a catalytic element that in turn removes harmful pollutants and replaces them with less harmful substances through a chemical process. Furthermore, the exhaust assembly is tasked with reducing or otherwise modifying the sound created by the combustion process of the engine by passing the exhaust gas through a series of baffles. With the passage of increasingly more stringent emissions laws, leaks or exhaust designs that allow gas to vent to the atmosphere before passing through the catalytic element can be problematic.

SUMMARY OF THE INVENTION

In some embodiments, the present invention provides an exhaust system for use on a motorcycle having an internal combustion engine with at least one exhaust port, the exhaust system including a first tubular member having a first end removeably coupled to the exhaust port of the internal combustion engine, and a second end, opposite the first end, forming a first connector. The first tubular member also includes a catalytic element positioned within the first tubular member between the first end and the second end, and where the first tubular member is gas-tight such that all exhaust gas entering the first end must pass through the catalytic element before exiting the second end. The exhaust system also includes a second member removeably coupled to the first connector of the first member, the second member having one or more baffles positioned therein.

In another embodiment, the present invention provides a baffle casing configured to be releaseably coupleable to an exhaust system of a motorcycle, the baffle casing including a substantially cylindrical body having one or more baffles contained therein, the body also having a first end at least partially defining an outlet aperture, and a second end opposite the first end. The second end of the body defines a plurality of apertures disposed circumferentially about the body of the baffle casing.

In still another embodiment, the present invention provides a multi-piece muffler housing for use on a motorcycle exhaust system, the multi-piece muffler housing including a first casing including a first substantially cylindrical body having a first end and at least one of a baffle or a catalytic element positioned therein. Where the first substantially cylindrical body defines a plurality of t-shaped slots positioned proximate the first end. The multi-piece muffler housing also includes a second casing including a second substantially cylindrical body having a second end and the other of a baffle or a catalytic element positioned therein, and where the second end includes a first sealing surface, a second sealing surface, and a locking channel positioned between the first and second sealing surfaces, and where the first end of the first casing is configured to be removeably coupled to the second end of the second casing. The multi-piece muffler housing also including a locking ring configured to secure the second casing to the first casing.

In still another embodiment, the present invention provides a method of replacing a baffle casing, the method including introducing a first end of a first casing axially onto the second end of a second casing, where the first casing defines a slot proximate the first end and includes one or more baffles therein, and where the second casing includes a locking channel and contains a catalytic element therein. The method also includes providing a locking ring having a radially inwardly extending locking protrusion, aligning the locking protrusion with the slot of the first casing and the locking channel of the second casing, and coupling the first casing to the second casing with the locking ring such that each locking protrusion extends radially through the slot of the first casing and is positioned within the locking channel of the second casing.

Other aspects of the invention will become apparent by consideration of the detailed description and accompanying drawings.

DETAILED DESCRIPTION

Figure 1:
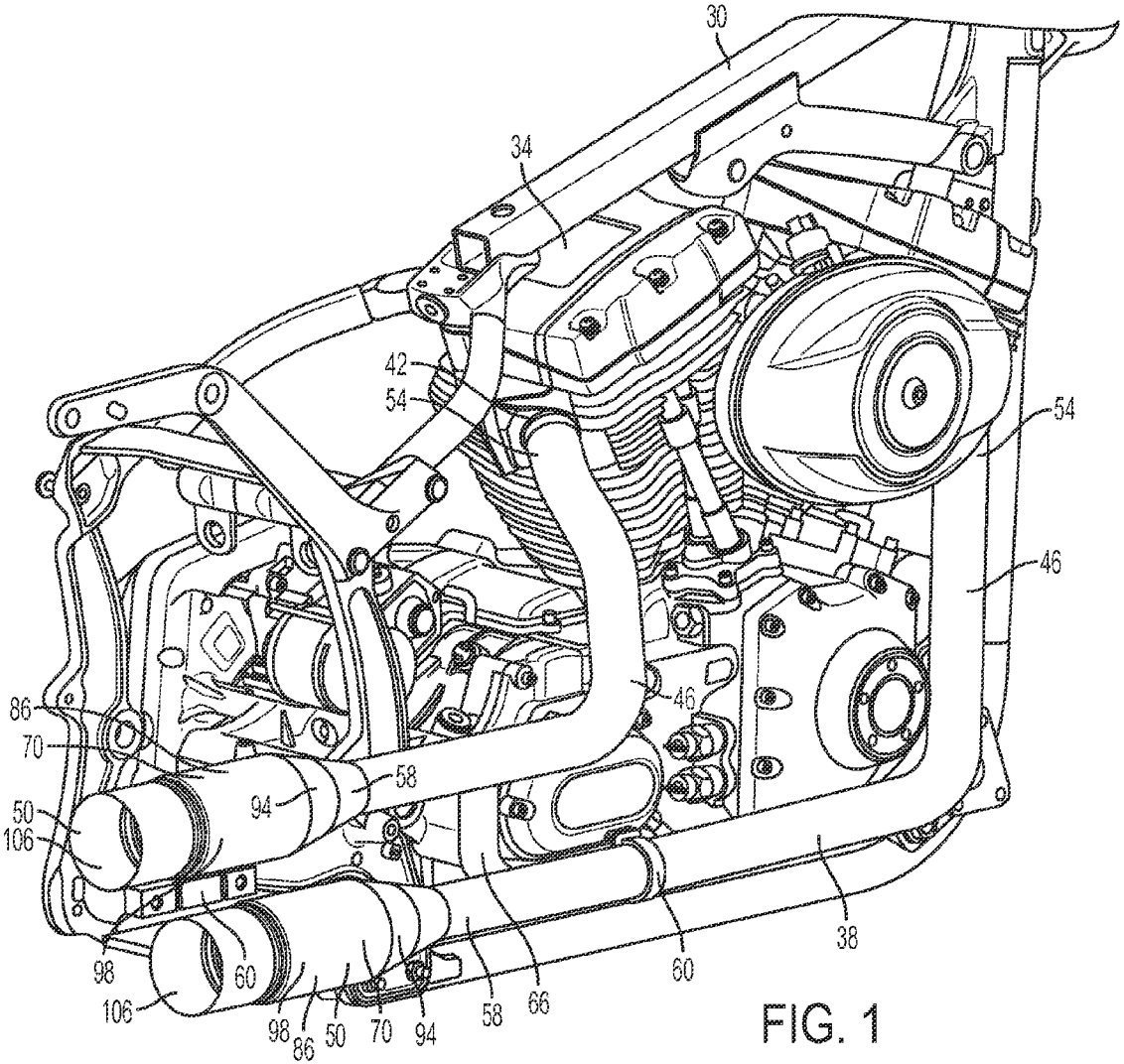
FIG. 1 is a perspective view of one construction of the exhaust assembly of the present invention with a baffle casing removed.

It is to be understood that the invention is not limited in its application to the details of construction and the arrangements of the components set forth in the following description or embodiments, or illustrated in the drawings. The invention is capable of other embodiments and of being practiced or being carried out in various ways. Also, it is to be understood that the phraseology and terminology used herein is for the purpose of description and should not be regarded as limiting.

Figure 2:
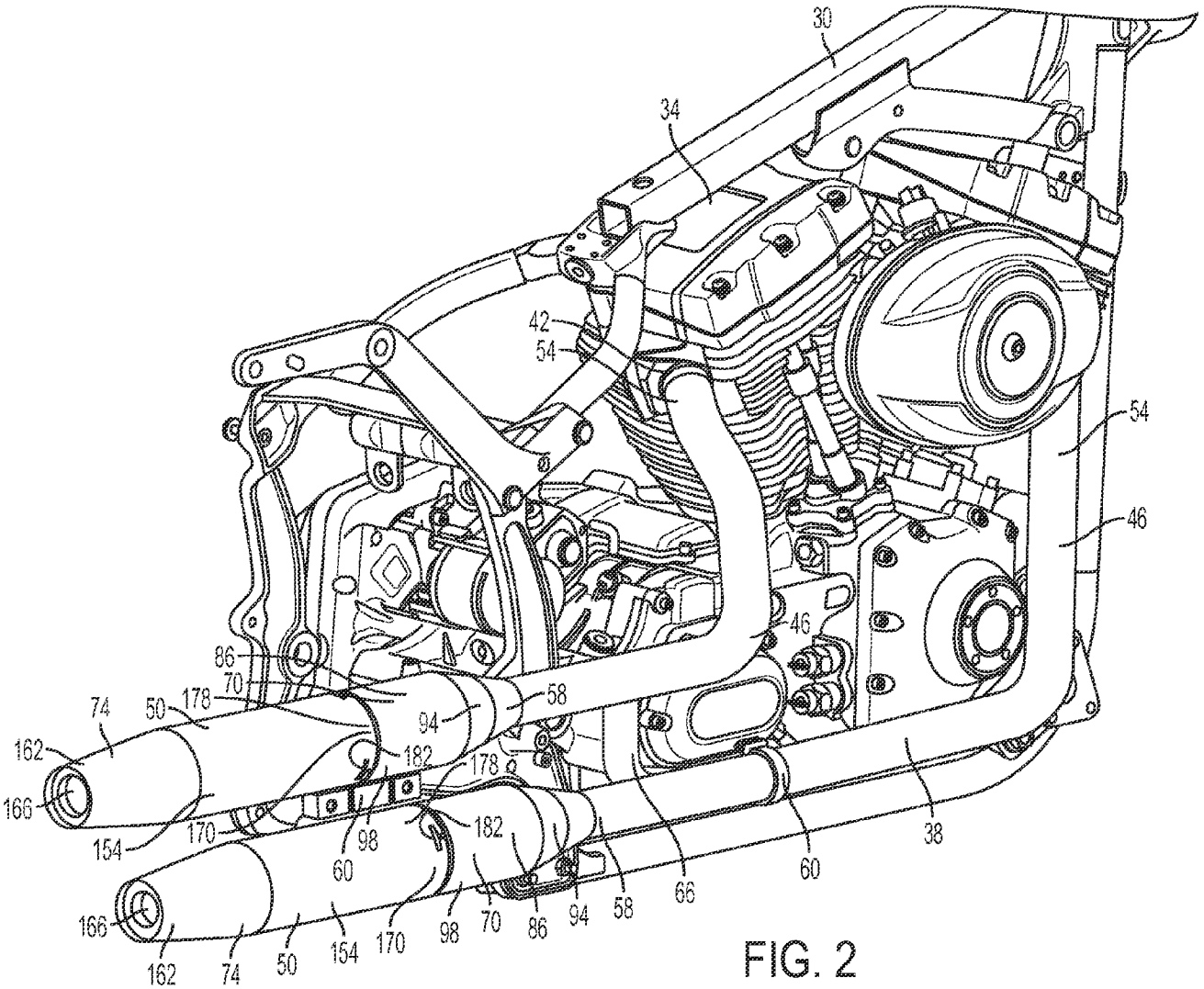
FIG. 2 illustrates the exhaust assembly of FIG. 1 with the baffle casing positioned on a catalyst casing.
Figure 3:
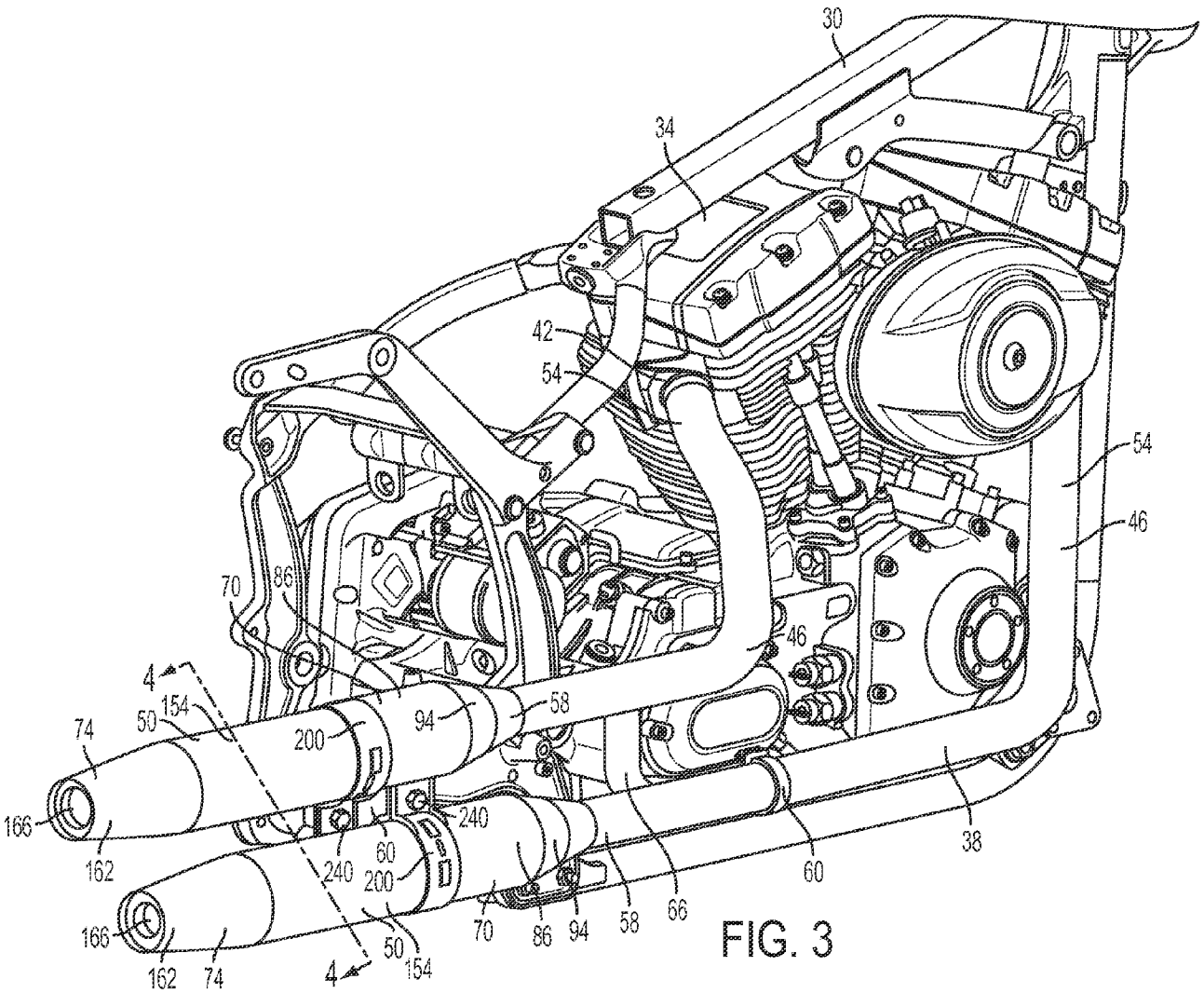
FIG. 3 illustrates the exhaust assembly of FIG. 2 with the baffle casing secured to the catalyst casing with a locking ring.

FIGS. 1-3 illustrate a portion of a motorcycle 20 including a motorcycle frame 30, an engine 34 coupled to the frame 30, and an exhaust system 38 coupled to the frame 30. In the illustrated construction, the engine 34 is securely fastened to the frame 30 and includes a plurality (i.e., two) of exhaust ports 42 each generally corresponding to a cylinder of the engine 34. Although the present invention is installed on a soft-tail motorcycle frame having a V-twin engine, the exhaust system 38 may be adapted to fit numerous frame and engine combinations.

Illustrated in FIGS. 1-6, 8-15, the motorcycle exhaust system 38 includes a pair of headers 46, each coupled to an exhaust port 42 of the engine 34; a pair of muffler housings 50, each coupled to a respective header 46; and a pair of locking rings 200, each associated with a respective muffler housing 50. The exhaust system 38 also includes one or more brackets 60 securing the exhaust system 38 to the motorcycle frame 30. Specifically, the exhaust system 38 of the present invention is a "dual-exhaust" system having two headers 46 each of which collect exhaust gas from a respective one of the exhaust ports 42 and direct it to a separate muffler housing 50 (see FIG. 3). In alternate constructions, a "single-exhaust" configuration may be present where either a single header 46 collects gas from a single cylinder engine and directs the gas into a single muffler housing 50 or multiple headers 46 collect exhaust gas from a multiple-cylinder engine and direct the gas into a single muffler housing 50.

Illustrated in FIGS. 1-4, each header 46 is generally tubular in shape allowing exhaust gas to flow therethrough. The header 46 includes a first end or inlet 54 coupleable to a respective one of the exhaust ports 42, and a second end or outlet 58 opposite the inlet 54. When the exhaust system 38 is assembled, the outlet 58 of the header 46 is sealingly coupled to a respective muffler housing 50, typically by welding. However in alternative embodiments, the outlet 58 may be sealingly coupled to the muffler housing 50 by a clamp (not shown).

In the illustrated construction, each header 46 is generally formed from a unitary piece of material; however, in alternative embodiments multiple tubular elements may be joined to form a single header tube. In such constructions, it is important to maintain a gas-tight construction along the length of the header 46 between the inlet 54 and the outlet 58 such that no untreated exhaust gas can escape the system 38. In still other embodiments, the header 46 and at least a portion of the muffler housing 50 (i.e., the catalyst casing 70, described below) may be formed from a single piece of material.

The exhaust system 38 may also include one or more cross-over pipes 66 extending between various headers 46 to allow exhaust gas to flow therebetween (FIGS. 1-3). In such embodiments, the cross-over pipes 66 permit the exhaust gas to travel between each header 46 while maintaining a gas-tight environment upstream of the catalytic element 82. Specifically, the cross-over pipe 66 permits the exhaust gas to flow between the headers 46 to compensate for changes in exhaust pressure but does not allow the exhaust gas to leave the system 38. Generally speaking, each end of the cross-over pipe 66 is sealingly coupled to a corresponding header 46 forming a gas-tight seal therebetween.

Illustrated in FIGS. 1-6, and 8-10, the multi-piece muffler housing 50 of the exhaust system 38 includes a catalyst casing 70, and a baffle casing 74 removeably coupled to the catalyst casing 70 forming a substantially tubular member. In the illustrated embodiment, the multi-piece muffler housing 50 is designed such that the baffle casing 74 may be easily detached from the catalyst casing 70 without replacing the entire muffler housing 50 or compromising the gas-tight integrity upstream of a catalytic element 82 within the catalytic casing 70. Since untreated exhaust gas is more harmful to the atmosphere, the joint between the catalyst casing 70 and the baffle casing 74 is positioned downstream of the catalytic element 82. As such, any leakage associated with the joint only permits treated exhaust gas to leak into the atmosphere while all untreated exhaust gas would remain in the system 38. Additionally, the detachable baffle casing also allows for simplified access to the catalyst casing 70 and catalyst element 82 for replacement of the catalyst element 82.

Illustrated in FIGS. 1-6, and 8, the catalyst casing 70 of the multi-piece muffler housing 50 includes a substantially cylindrical body 86 defining a first outer diameter 90. As mentioned above, the catalyst casing 70 also includes the catalytic element 82 positioned within the body 86 and positioned such that any exhaust gas flowing through the catalyst casing 70 must pass through the catalytic element 82. As is well known in the art, the catalytic element 82 is configured to treat exhaust gas flowing therethrough by converting toxic pollutants into less toxic substances via a chemical reaction.

Figure 4:
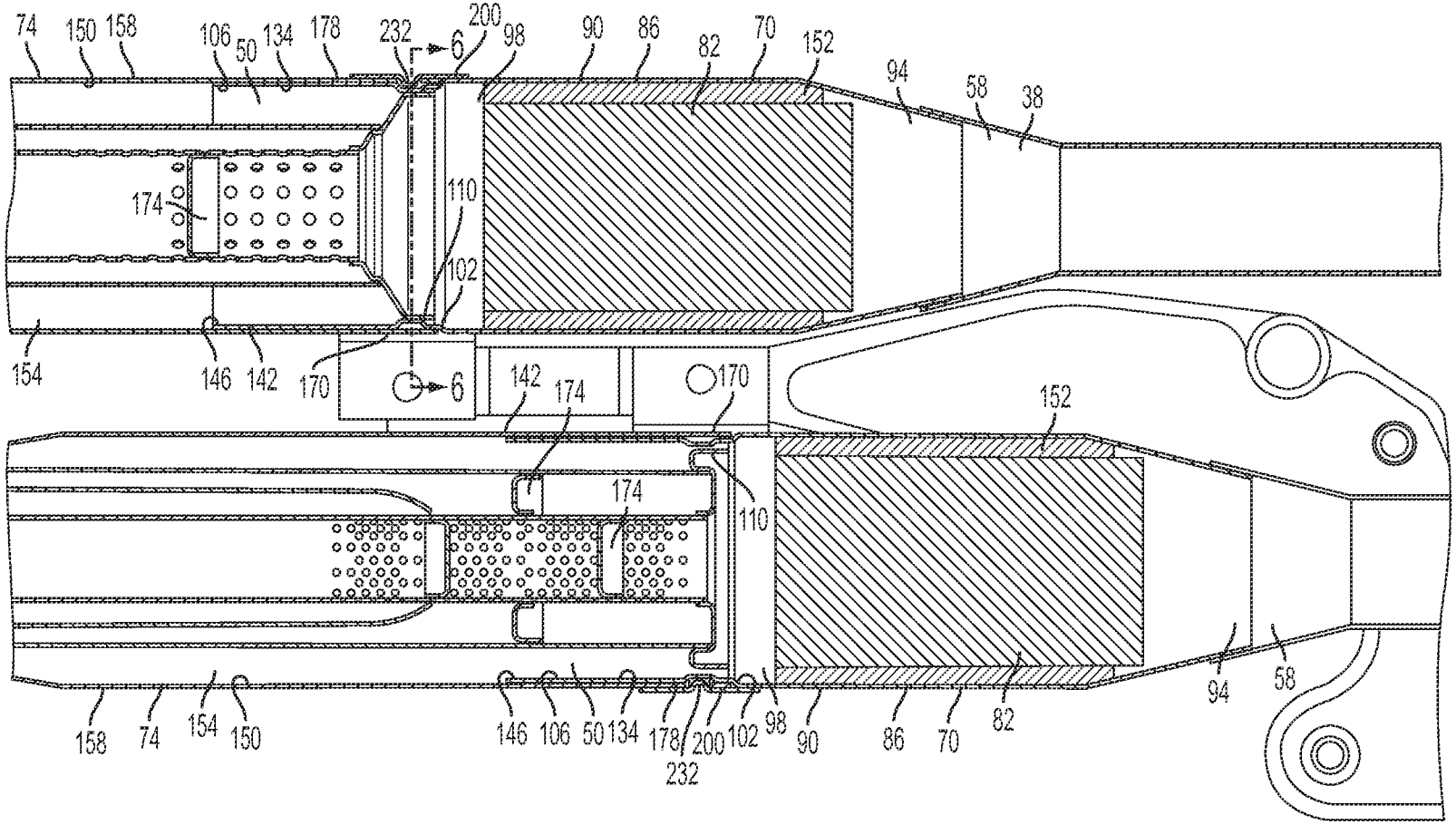
FIG. 4 is a section view taken along line 4-4 in FIG. 3.

When assembled, a first end 94 of the catalyst casing 70 is sealingly coupled to the outlet 58 of a respective header 46 forming a gas-tight seal therebetween (FIG. 4). More specifically, the header 46 and catalyst casing 70 are configured such that any exhaust gas that enters the inlet 54 of the header 46 must flow into the catalyst casing 70 and through the catalytic element 82. In the case of a dual-exhaust system where a cross-over pipe 66 is present (FIGS. 1-3), the exhaust system 38 is configured such that any exhaust gas entering either inlet 54 must flow into one of the two catalyst casings 70 and through a corresponding catalytic element 82.

Figure 5:
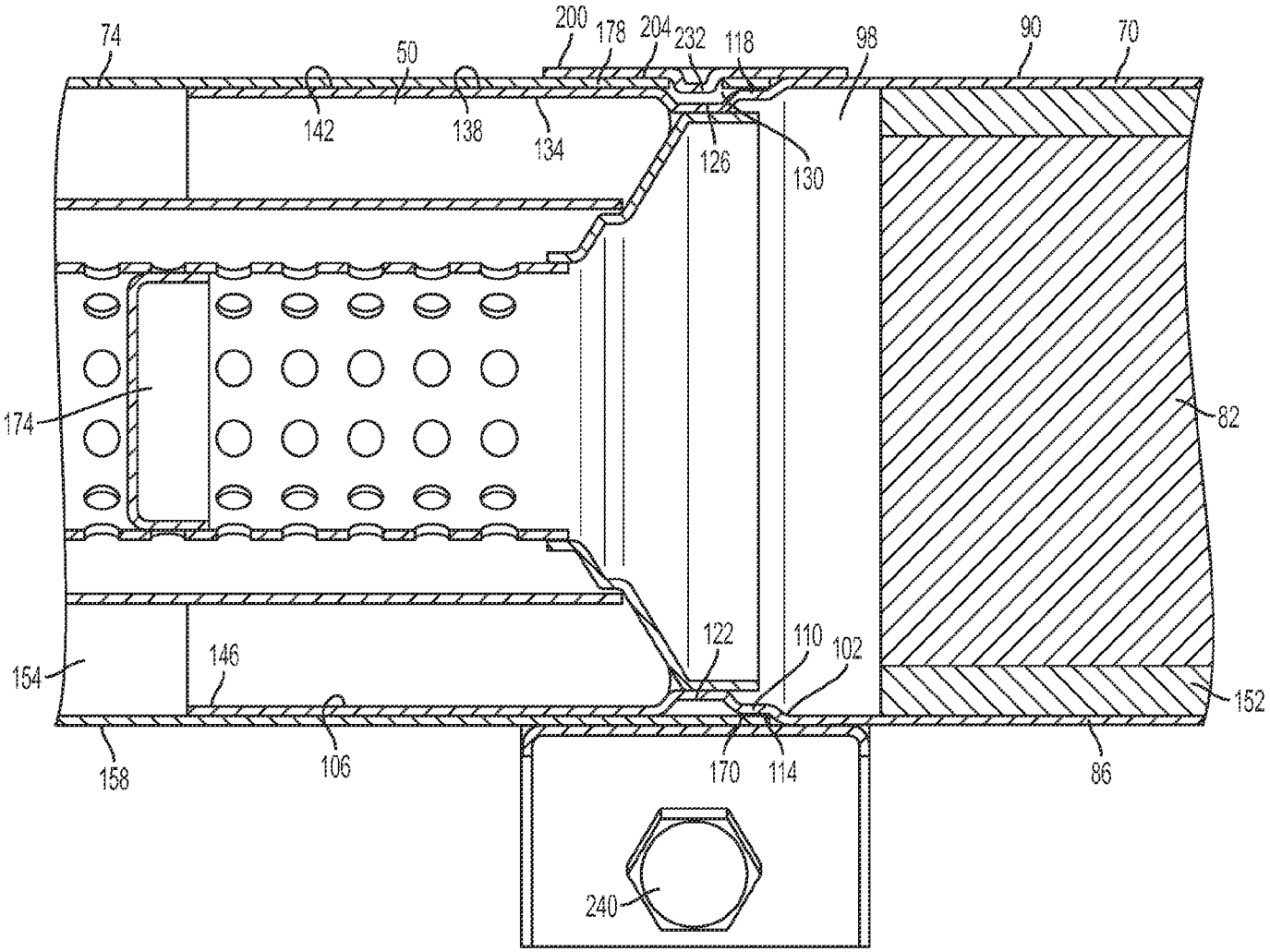
FIG. 5 is a detailed view of the exhaust assembly illustrated in FIG. 4.

Best illustrated in FIG. 5, a second end 98 of the catalyst casing 70 includes a series of annular walls extending from a base edge 102 to produce a first connector 106. During use, the first connector 106 is configured to be at least partially received within the baffle casing 74 and form a joint therewith. In the illustrated embodiment, the first connector 106 includes a first annular wall 110 extending rearwardly from the base edge 102 at a second diameter 114 smaller than the first diameter 90 to form a first sealing surface 118. The first connector 106 also includes a second annular wall 122 extending rearwardly from the first annular wall 110 at a third diameter 126 smaller than the second diameter 114 to form a locking channel 130. Finally, the first connector 106 includes a third annular wall 134 extending rearwardly from the second annular wall 122 at a fourth diameter 138 to form a second sealing surface 142 and a distal edge 146. The first and second sealing surfaces 118, 142 are parallel one another and form a substantially similar diameter generally corresponding to the inner diameter 150 of the baffle casing 74.

Figure 7:
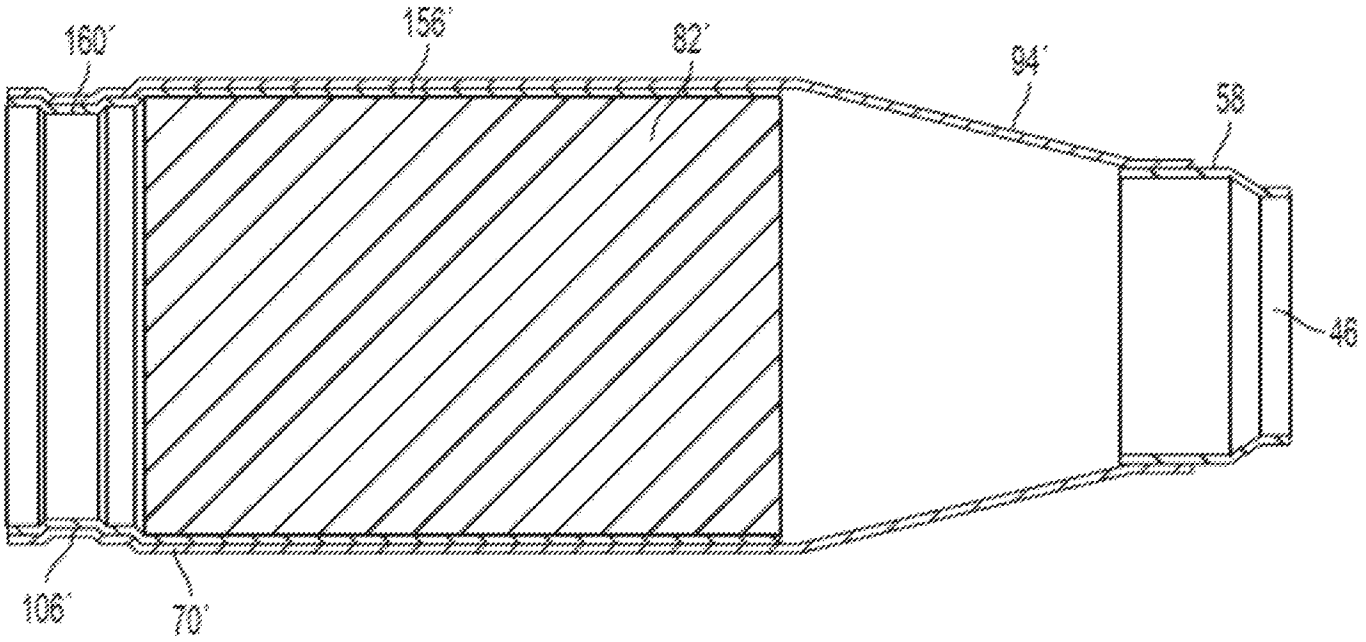
FIG. 7 illustrates an alternative construction of the catalyst casing illustrated in FIG. 4.
Figure 8:
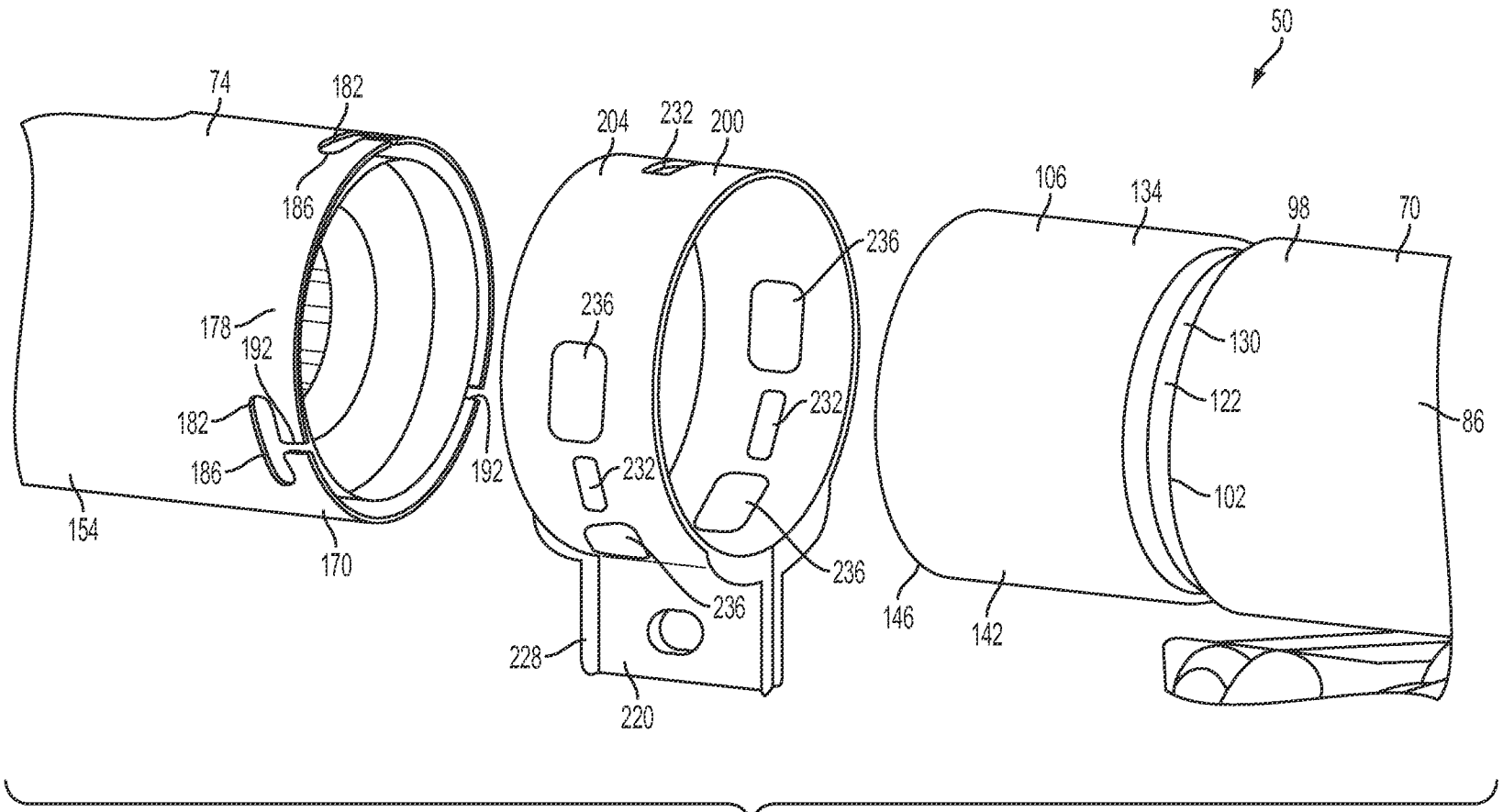
FIG. 8 is an exploded view of the exhaust assembly of FIG. 3.
Figure 9:
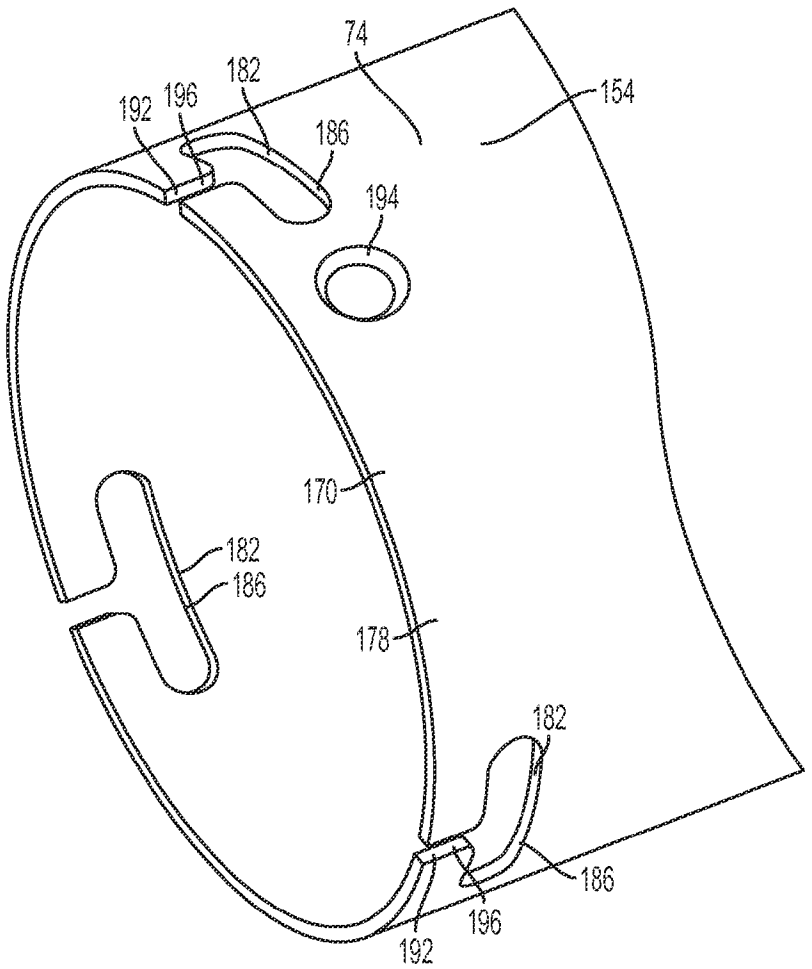
FIG. 9 is a detailed view of the second end of the baffle casing illustrated in FIG. 8.
Figure 11:
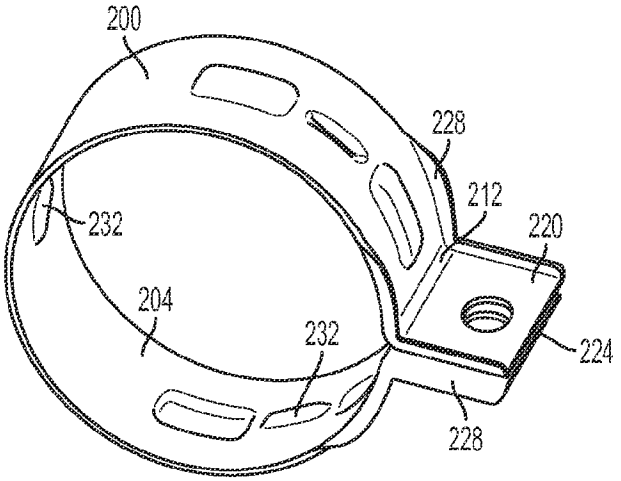
FIGS. 11-14 illustrate the locking ring of FIG. 3.
Figure 12:
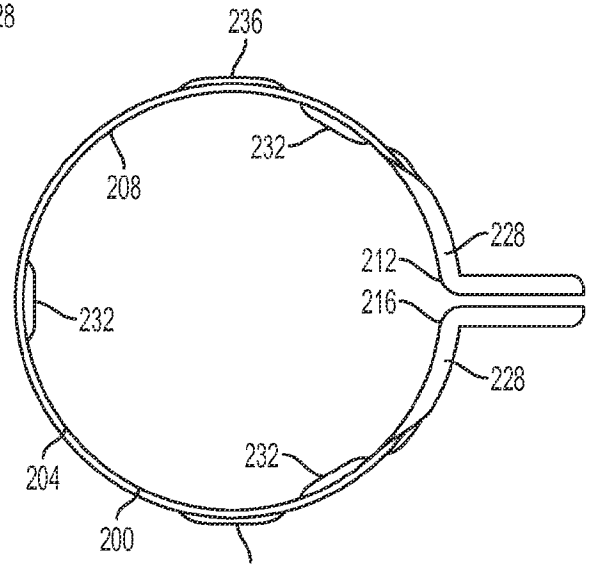

Illustrated in FIGS. 4 and 5, the catalytic element 82 of the exhaust system 38 is mounted within the catalyst casing 70 using a mat 152. Specifically, the catalytic element 82 is wrapped in the mat 152 and positioned within the casing 70 as is known in the art. In an alternative construction, the catalytic element 82' may be mounted in the catalytic casing 70' using a mechanical lock (FIG. 7). In the mechanical lock, the substrate of the catalytic element 82' is brazed or otherwise coupled to a mantle 156' extending around the outer diameter of the catalytic element 82'. The catalytic element 82' and mantel 156' combination is then locked into place within the catalytic casing 70' by forming the distal end 160' of the mantel 156' to match the interior contour of the first connector 106'. While the illustrated mantle 156' utilizes the geometry of the first connector 106' to create the desired locking effect, any notch or similar locking geometry may be used to axially fix the mantle 156' with respect to the catalytic casing 70'.

Illustrated in FIGS. 2-6, and 8-10, the baffle casing 74 includes a substantially cylindrical body 154 having an outer diameter 158 substantially equal to the first diameter 90 of the catalyst casing 70. The body 154 includes a first end 162 defining an outlet aperture 166, and a second end 170 opposite the first end 162. The baffle casing 74 also includes a plurality of baffles 174 positioned therein that are configured to alter or otherwise reduce the noise produced during the combustion process of the internal combustion engine 34. When the exhaust system 38 is assembled, treated exhaust gas flowing from the catalyst casing 70 then flows into the baffle casing 74 and through the baffles 174. After passing through the baffles 174, the exhaust gas is ultimately vented to the atmosphere through the outlet aperture 166.

Figure 6:
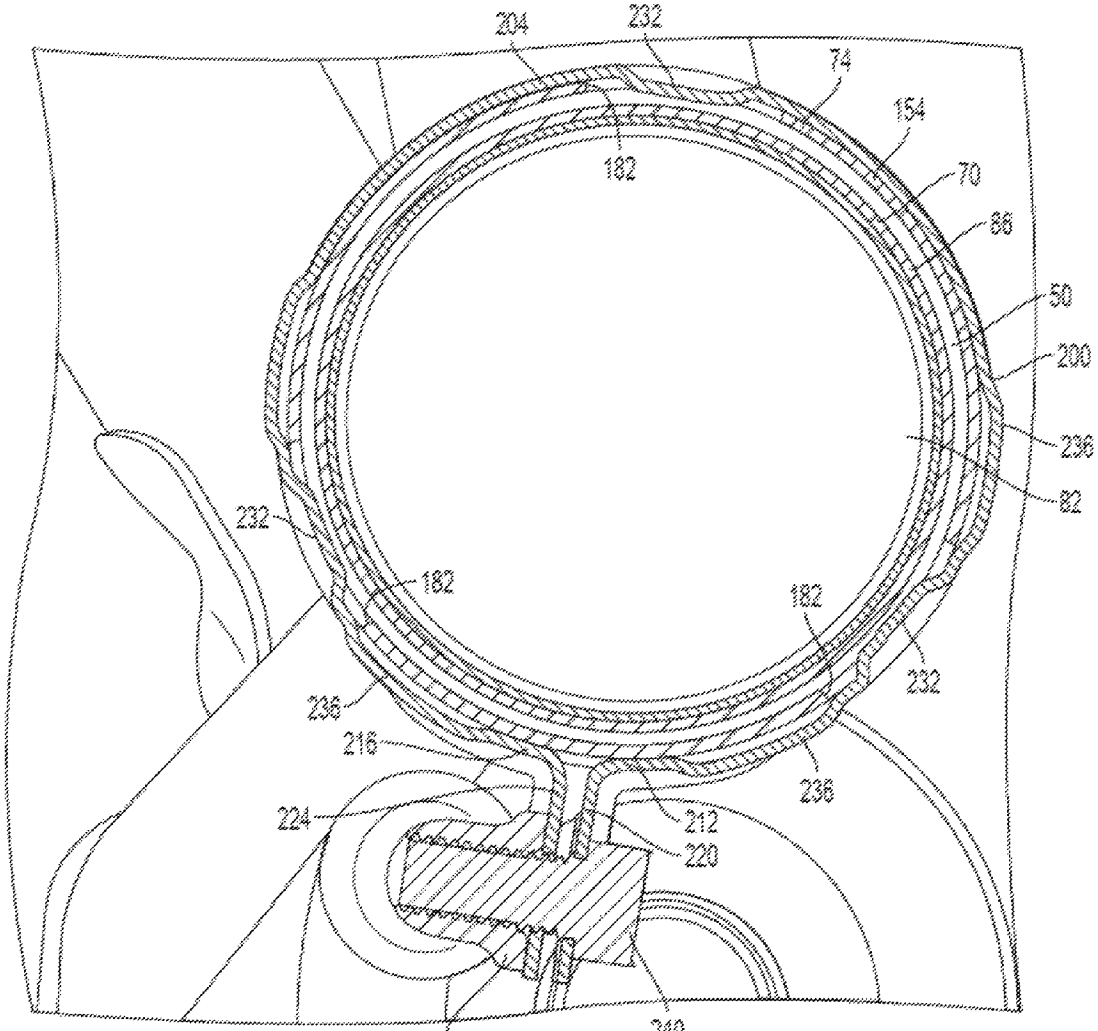
FIG. 6 is a section view taken along line 6-6 of FIG. 4.

The second end 170 of the baffle casing 74 produces a second connector 178 configured to releaseably engage the first connector 106 of the catalyst casing 70. More specifically, the second connector 178 includes a plurality of t-shaped slots 182 (FIGS. 8-10), each equally spaced circumferentially around the body 154 proximate the second end 170. In the illustrated construction, each slot 182 includes a first leg 186 extending substantially circumferentially along the casing 74 and a second leg 192 extending forwardly from first leg 186 toward a second end 170. In the illustrated construction, the second leg 192 is open to the second end 170 of the baffle casing 74. When the baffle casing 74 is coupled to the catalyst casing 70, the first leg 186 of the slot 182 is positioned such that it axially aligns with the locking channel 130 of the catalyst housing 70 (FIGS. 4-6). In the illustrated construction, the baffle casing 74 includes three, equally spaced slots 182, however more or fewer slots 182 may be present.

Figure 10:
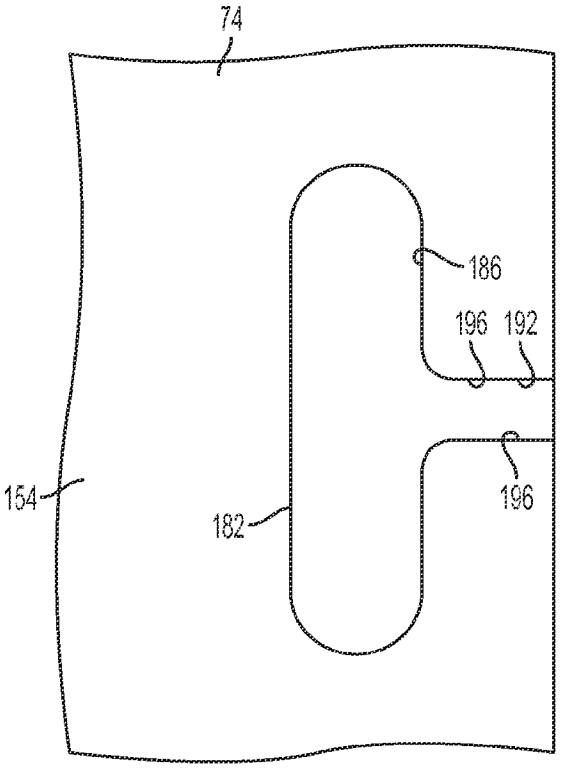
FIG. 10 is a detailed view of the t-shaped slot illustrated in FIG. 9.
Figure 13:
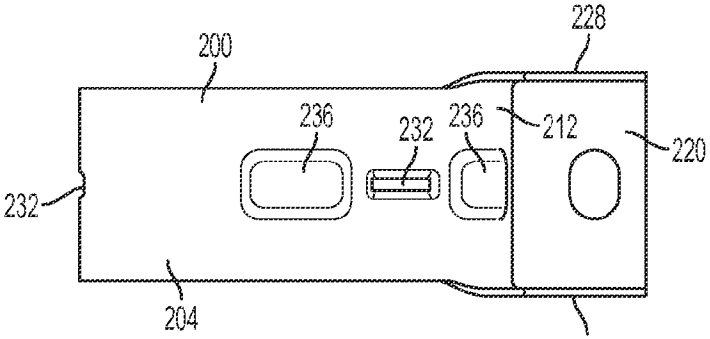
Figure 15:
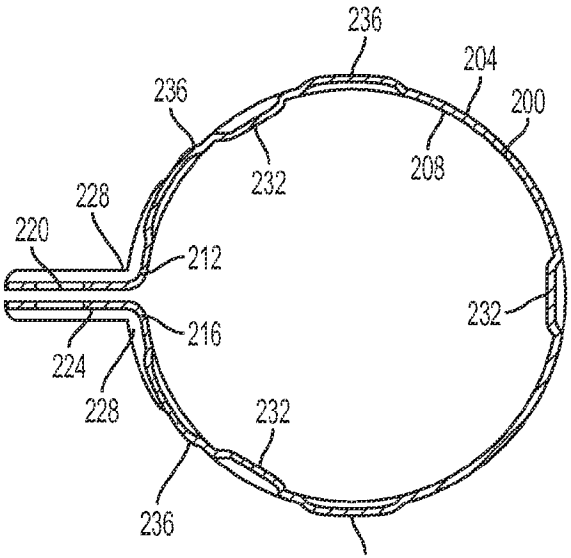
FIG. 15 is a section view taken along line 15-15 of FIG. 14.
Figure 14:
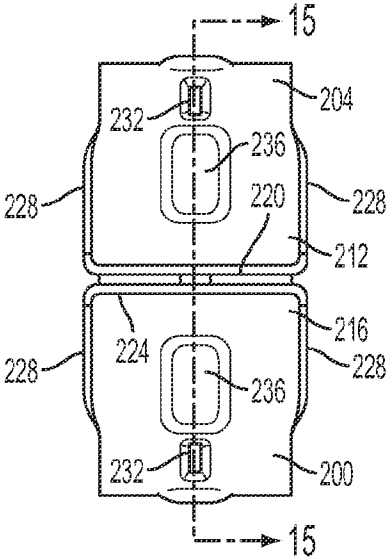

During use, the rearward distal edge 146 of the catalyst casing 70 is axially received within the second end 170 of the baffle casing 74. Once inserted, the body 154 of the baffle casing 74 is shaped such that its inner surface 198 comes into contact and forms a seal with the first and second sealing surfaces 118, 142. Furthermore, the position and shape of the slots 182 permit the second end 170 of the baffle casing 74 to resiliently "deflect" radially inwardly and engage the first sealing surface 118 of the catalyst casing 70. More specifically, the second end 170 of the baffle casing 74 deflects radially inwardly causing the opposing edges 196 of the second leg 192 of the slot 182 to move toward one another (FIG. 10). In the illustrated construction, the deflection is such that the opposing edges 196 contact one another when the baffle casing 74 is secured to the catalyst casing 70 by the locking ring 200.

The deflection capability of the second end 170 both increases the sealing ability of the joint and increases the axial holding strength of the joint. In alternative constructions, the second end 170 may also be configured to deflect radially outwardly during assembly to accept the end 106 of the catalytic casing 70.

Although the present construction illustrates the first connector 106 formed in the catalyst casing 70 while the second connector 178 is formed in the baffle casing 74, it is within the teachings of the present invention to swap the two connectors such that the geometry is formed in the opposing casing.

Illustrated in FIGS. 11-15, the locking ring 200 of the exhaust system 38 is substantially arcuate in shape having an elongated ribbon-like body 204 extending circumferentially to define an inner diameter 150, a first end 212, and a second end 216. The locking ring 200 also includes a first tab 220 extending radially from the first end 212 of the ring 200 and a second tab 224 extending radially from the second end 216 of the ring 200. During use, the two tabs 220, 224 may be positioned closer together (e.g., by a screw or fastener) causing the inner diameter 150 of the body 204 to decrease and a clamping action to occur. In contrast, allowing the distance between the tabs 220, 224 to increase permitting the inner diameter 208 of the ring 200 to increase. In the illustrated construction, a pair of ribs 228 extend between the body 204 and each tab 220, 224 to increase the rigidity of the locking ring 200. In the illustrated embodiment, the locking ring 200 also acts as a mounting point or bracket to secure the muffler housing 50 to the motorcycle frame 30 or other support structure.

The locking ring 200 also includes a plurality of locking protrusions 232 each extending radially inwardly from the body 204. When assembled, the each locking protrusion 232 extends radially through a corresponding first leg 186 of a t-shaped slot 182 of the baffle casing 74 and is received within the locking channel 130 of the catalysis casing 70 (FIGS. 4-6). As such, when the locking ring 200 is secured to the muffler system 38 the compressive force of the locking ring 200 increases the sealing capabilities of the joint—through radially deflecting the second end 170 into the first sealing surface 118—while the locking protrusions 232 restrict the relative axial movement of the baffle casing 74 with respect to the catalyst casing 70. Best shown in FIG. 8, the second leg 192 of the slot 182 is sized smaller than the width of the locking protrusion 232 such that the protrusion 232 cannot be axially removed from the slot 182 once the locking ring 200 is secured.

The locking ring 200 also includes a plurality of fastener protrusions 236 extending radially outwardly from the body 204. When assembled, each fastener protrusion 236 provides clearance for the head of a fastener driven into the joint (not shown). Specifically, to provide additional coupling ability, a screw or fastener may be driven radially through both the baffle casing 74 (i.e., through aperture 194, FIG. 9) and the catalyst casing 70. In such instances, the fastener protrusion 236 provides clearance for the fasteners head and hides the fastener from view.

To attach a baffle casing 74 to a catalyst casing 70, the second end 170 of the second connector 178 of the baffle casing 74 is slid over the first connector 106 of the catalyst casing 70. The baffle casing 74 is axially slid onto the first connector 106 until the second end 170 contacts the base edge 102 of the catalyst casing 70 (FIG. 2). When the baffle casing 74 is in position, the first leg 186 of the slot 182 axially aligns with the locking channel 130 and the inner surface 198 of the body 154 contacts the first and second sealing surfaces 118, 142.

With the baffle casing 74 in place, the locking ring 200 is axially slid along the length of the baffle casing 74 until the locking ring 200 is axially aligned with the t-shaped slots 182 (FIGS. 2 and 4-5). The locking ring 200 is then rotated until each locking protrusion 232 aligns with and is received within a corresponding t-shaped slot 182 of the baffle casing 74.

With the locking ring positioned, a fastener 240 is passed through both tabs 220, 224 of the locking ring 200 and secured by a nut 244 (see FIG. 6). In other embodiments, the fastener 240 may be directly threaded into a corresponding bracket 60 (see FIG. 3). The fastener 240 is then tightened causing the distance between the first tab 220 and the second tab 224 to decrease and the inner diameter 150 of the locking ring 200 to decrease. As a result of the decreasing inner diameter 150, a compressive force is placed on the second end 170 of the baffle casing 74 causing it to flex radially inward and into contact with the first sealing surface 118 of the catalyst casing 70. As discussed above, the result is a secure joint having an increased holding and sealing capacity.

To remove the baffle casing 74 from the catalyst casing 70, the fastener 240 is loosened, causing the distance between the two tabs 220, 224 to increase and the inner diameter 150 of the locking ring 200 to enlarge. As such, the second end 170 of the baffle casing 74 elastically returns to its initial position and disengages from the first sealing surface 118. With the locking ring 200 loosened, the locking ring 200 and baffle casing 74 may be axially removed from the catalyst casing 70.

Various features and advantages of the invention are set forth in the following claims.

The invention claimed is:

1. An exhaust system for use on a motorcycle having an internal combustion engine with at least one exhaust port, the exhaust system comprising:

a first exhaust section including a header and a catalyst casing, the first exhaust section having a first end removeably coupled to the exhaust port of the internal combustion engine and a second end, opposite the first end, forming a first connector, wherein the first exhaust section also includes a catalytic element positioned within the catalyst casing;

a second exhaust section removeably coupled to the first connector of the first exhaust section, the second exhaust section having one or more baffles positioned therein;

wherein the header and the catalyst casing are either formed from a continuous piece of material or the header is welded to the catalyst casing; and a locking ring securing the second exhaust section to the first exhaust section, wherein the locking ring includes a plurality of radially inwardly extending locking protrusions, wherein the second end of the first exhaust section includes a locking channel, wherein the second exhaust section defines a plurality of slots, and wherein each locking protrusion extends through a corresponding slot in the second exhaust section and is positioned within the locking channel of the first exhaust section when the first exhaust section is coupled to the second exhaust section.

2. The exhaust system of claim 1, wherein the locking ring at least partially secures the exhaust system to a motorcycle frame.

3. The exhaust system of claim 1, wherein the second end of the first exhaust section includes a first sealing surface and a second sealing surface spaced from the first sealing surface, and wherein both the first sealing surface and the second sealing surface contact the second exhaust section when the second exhaust section is coupled to the first exhaust section.

4. The exhaust system of claim 3, wherein the first sealing surface and the second sealing surface are substantially parallel each other.

5. The exhaust system of claim 1, wherein the second exhaust section includes a distal end, and wherein the plurality of slots are proximate the distal end.

6. An exhaust system for use on a motorcycle having an internal combustion engine with at least one exhaust port, the exhaust system comprising:

a first exhaust section including a header and a catalyst casing, the first exhaust section having a first end removeably coupled to the exhaust port of the internal combustion engine and a second end, opposite the first end, forming a first connector, wherein the first exhaust section also includes a catalytic element positioned within the catalyst casing; and a second exhaust section removeably coupled to the first connector of the first exhaust section, the second exhaust section having one or more baffles positioned therein, wherein the header and the catalyst casing are either formed from a continuous piece of material or the header is welded to the catalyst casing, wherein the second exhaust section includes a distal end, and the second exhaust section defines a plurality of slots proximate the distal end, wherein each slot is t-shaped.

7. The exhaust system of claim 6, wherein the t-shaped slot includes a first leg extending circumferentially around the second exhaust section and a second leg extending substantially axially from the first leg, and wherein the second leg is open to the second end.

8. A baffle casing configured to be releaseably coupled with a locking ring to a catalyst casing of an exhaust system of a motorcycle, the baffle casing comprising:

a body having one or more baffles contained therein, the body also having a first end at least partially defining an outlet aperture, and a second end opposite the first end, the second end including a substantially cylindrical outer wall configured to receive an end of the catalyst casing, the second end of the body including a plurality of apertures spaced circumferentially about the substantially cylindrical outer wall, wherein the apertures are configured to receive locking protrusions of a locking ring such that the locking protrusions engage a locking channel of the catalyst casing.

9. The baffle casing of claim 8, wherein each aperture includes a slot extending substantially circumferentially about the body of the baffle casing.

10. The baffle casing of claim 8, wherein each aperture includes a slot having a first leg extending substantially circumferentially about the substantially cylindrical outer wall of the baffle casing and a second leg extending axially from the first leg toward the second end, and wherein the second leg is open to the second end.

11. The baffle casing of claim 8, wherein each aperture includes a slot extending axially, and wherein each slot defines a width between 0.100 to 0.150 inches.

12. A multi-piece muffler housing for use on a motorcycle exhaust system, the multi-piece muffler housing comprising:

a first casing including a first substantially cylindrical body having a first end and at least one of a baffle or a catalytic element positioned therein, wherein the first substantially cylindrical body defines a plurality of t-shaped slots positioned proximate the first end;

a second casing including a second substantially cylindrical body having a second end and the other of a baffle or a catalytic element positioned therein, and wherein the second end includes a first sealing surface, a second sealing surface, and a locking channel positioned between the first and second sealing surfaces, and wherein the first end of the first casing is configured to be removeably coupled to the second end of the second casing; and a locking ring configured to secure the second casing to the first casing.

13. The muffler housing of claim 12, wherein the locking ring includes a plurality of radially inwardly extending locking protrusions.

14. The muffler housing of claim 13, wherein each locking protrusion is configured to extend through a corresponding t-shaped slot of the first casing and be received within the locking channel of the second casing.

15. The muffler housing of claim 12, wherein the first end of the first casing is deflectable radially inwardly.

16. The muffler housing of claim 12, wherein at least one leg of the t-shaped slots is open to the first end.

17. The muffler housing of claim 12, wherein the first sealing surface extends axially from the second end, the locking channel extends axially from the first sealing surface at a diameter less than that of the first sealing surface, and wherein the second sealing surface extends axially from the locking channel at a diameter greater than the diameter of the locking channel.

18. A method of replacing a baffle casing, the method comprising:

introducing a first end of a first casing axially onto a second end of a second casing, wherein the first casing defines a slot proximate the first end and includes one or more baffles therein, and wherein the second casing includes a locking channel and contains a catalytic element therein;

providing a locking ring having a radially inwardly extending locking protrusion;

aligning the locking protrusion with the slot of the first casing and the locking channel of the second casing; and coupling the first casing to the second casing with the locking ring such that each locking protrusion extends radially through the slot of the first casing and is positioned within the locking channel of the second casing.

19. The method of claim 18, wherein coupling the first casing to the second casing includes deflecting the first end of the first casing radially inwardly.

* * * * *